US006623308B2

(12) United States Patent
Ono

(10) Patent No.: US 6,623,308 B2
(45) Date of Patent: Sep. 23, 2003

(54) CONNECTOR

(75) Inventor: Hisahiro Ono, Tsu (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 10/048,491

(22) PCT Filed: Jun. 18, 2001

(86) PCT No.: PCT/JP01/05185

§ 371 (c)(1),
(2), (4) Date: Apr. 12, 2002

(87) PCT Pub. No.: WO01/97335

PCT Pub. Date: Dec. 20, 2001

(65) Prior Publication Data

US 2002/0137396 A1 Sep. 26, 2002

(30) Foreign Application Priority Data

Jun. 16, 2000 (JP) ..... 2000-182207

(51) Int. Cl.[7] ..... H01R 13/64
(52) U.S. Cl. ..... 439/680; 439/660
(58) Field of Search ..... 439/680, 681, 439/677, 660, 74

(56) References Cited

U.S. PATENT DOCUMENTS 4,533,203 A * 8/1985 Feldman et al. ..... 439/681
5,044,994 A * 9/1991 Van Woensel ..... 439/681
5,882,212 A 3/1999 McHugh et al.
5,921,787 A * 7/1999 Pope et al. ..... 439/74
6,106,306 A * 8/2000 Koga et al. ..... 439/74

FOREIGN PATENT DOCUMENTS

EP 0991148 4/2000
JP 9-213432 8/1997

OTHER PUBLICATIONS

English Language Abstract of JP 9–213432.

* cited by examiner

*Primary Examiner*—Ross Gushi
(74) *Attorney, Agent, or Firm*—Greenblum & Bernstein, P.L.L.C.

(57) ABSTRACT

A socket body of a connector has an engaging rib provided on the bottom of an insertion slot thereof. The engaging rib has an engaging recess provided in the distal end while a header body of the connector has an engaging slot provided for engaging with the engaging rib and also an engaging projection provided at the engaging slot for engaging with the engaging recess. When the engaging rib is inserted into the engaging slot and the engaging recess accepts the engaging projection, the socket body remains free from any adverse impact at its end portions and can thus be protected from damage. This also allows the end portions to be reduced in thickness, thus decreasing the dimensions of the connector. Moreover, as the positioning accuracy between the socket body and the heater body is improved, the electrical connection between a socket and a header of the connector will be ensured without contact error.

13 Claims, 17 Drawing Sheets

CONNECTOR

FIELD OF THE INVENTION

The present invention relates to a connector having a socket and a header arranged connectable to a couple of printed circuit boards respectively for connection between the printed circuit boards.

BACKGROUND OF THE INVENTION

Conventionally, a connector is known comprising a socket 50 and a header 60 which can be connected to a couple of unshown printed circuit boards respectively as shown in FIG. 21.

The socket 50 includes a set of contacts 59 and a socket body 51 which is made of a resin mold having substantially a rectangular cylinder shape where the contacts 59 are aligned on two lengthwisely extending side walls 55, 55 of the socket body 51. Each of the contacts 59 has a substantially rectangular, narrow shape extending along the axial direction of the cylindrical socket body 51. One end of the contact 59 projecting out from one opening of the socket body 51 is bent outwardly to extend in substantially the vertical direction and designated as a connecting tab 59*b* arranged connectable with a wiring pattern of the printed circuit board.

The header 60 includes a set of receiver contacts (namely posts) 69 arranged directly connectable with the contacts 59 of the socket 50 and a header body 61 made of a resin mold having a substantially rectangular shape on which the receiver contacts 69 are mounted.

The header body 61 includes two lengthwisely extending sides 65, 65, each side having a row of recesses 65*a* provided therein extending substantially vertical to the lengthwise direction and linked to a lengthwisely extending flange 66 projected substantially orthogonal to the side.

The receiver contacts 69 are accommodated in the corresponding recesses 65*a* with their connecting tabs 69*a* extending outwardly from each side 65 of the header body 61 for direct contact with the contacts 59 of the socket 50 and arranged flexible for extending in the outward direction of the flange 66. One end of the receiver contact 69 projects from the rear of the header body 61 and extends in the outward direction of the flange 66 and, similar to the contact 59 of the socket 50, designated as a connecting tab 69*b* arranged connectable with a wiring pattern of a printed circuit board.

The socket 50 and the header 60 are joined at the connecting tabs 59*b* and 69*b* of the contacts 59 and the receiver contacts 69 by soldering to the corresponding wiring patterns of two different printed circuit boards respectively. When the header 60 is inserted into an insertion slot of the socket body 51, its receiver contacts 69 engage directly with the corresponding contacts 59 of the socket 50 to electrically connect between the two printed circuit boards.

In connection, both the socket 50 and the header 60 of the connector support their respective printed circuit boards on which other components are mounted and remain loaded by the total weight of the boards and the components. Accordingly, in case that two different printed circuit boards joined to each other by a combination of the socket 50 and the header 60 are installed in a mobile instrument and when carried and fallen down to the ground accidentally, they may receive a great impact on the socket body 51 and the header body 61. As a result, the socket body 51 will possibly be stressed by an undesired load and fractured at its lengthwise sides which are thinner than the other portions.

Also, as the socket body 51 of a molded structure is commonly shaped by injection forming, its one end opposite to the other end having an inlet gate for filling the cavity with a molten resin acts as a final confluence point where separate flows of the molten resin are joined up. At the final confluence point, the molded structure may have a weld line depending on the material resin, the shape of the structure, and the molding conditions, thus being declined in the physical strength or the structural stability.

For example, the socket body 51 shown in FIG. 21 has one end of the lengthwise structure thereof designated as the final confluence point where a weld line denoted by "a" is possibly developed and may hence be fractured in the end.

It is only practical for avoiding the fracture of the socket body 51 to increase the thicknesses Wa and Wb of both lengthwise end walls of the socket body 51. This will however enlarge the overall dimensions of the connector.

Also, the greater the number of the contacts 59 or the receiver contacts 69, the longer the length of the socket body 51 or the header body 61 is increased. This may result in variations in the positioning accuracy of the socket body 51 or the header body 61 due to thermal expansion or contraction during the molding. For minimizing its dimensions, the connector having large numbers of the contacts 59 and the receiver contacts 69 is adapted by reducing the width of the contacts 59 and the receiver contacts 69 as well as the pitch between them. If the positioning accuracy is varied, the connection between the contacts 59 and the receiver contacts 69 may be disturbed.

It is an object of the present invention for eliminating the above problems to provide a connector which is minimized in the dimensions while inhibiting any injury of the socket by adverse impact and failure of the connection between the socket and the header.

SUMMARY OF THE INVENTION

According to claim 1 of the present invention, a connector having a socket which consists mainly of a plurality of contacts and a socket body of a molded form on which the contacts are aligned and a header which consists mainly of a plurality of receiver contacts arranged connectable with the corresponding contacts and a header body on which the receiver contacts are aligned, so that the header is inserted into an insertion slot of the socket body to electrically connect between the contacts and the receiver contacts, is featured in that an engaging rib is provided at the bottom of the insertion slot on the facing side of the socket body and an engaging slot is provided in the facing side of the header so that the two can be engaged with each other along the direction of header insertion, and also at least one or more sets of engaging recesses and engaging projections are provided in the facing side of the engaging rib and at the engaging slot on the facing side of the header respectively so that each set of the two can be engaged with each other along the direction of head insertion.

Consequently, when the header is inserted into the socket, its engaging recess tightly engages with the engaging projection of the socket thus allowing an adverse impact of load generated substantially orthogonal to the direction of header insertion to be received by the socket body about the engaging recess where the physical strength is consistently high but not by the rim of the insertion slot of the socket body where weld lines may easily be developed and thus protecting the socket from injury. Hence, as the rim of the socket body is reduced in the thickness, the overall dimensions of the connector can be minimized. Also, the positioning accuracy between the socket body and the header body can be improved by the effect of close engagement of the engaging recess with the engaging projection thus ensuring the electrical connection between the contacts of the socket and the receiver contacts of the header without contact errors.

According to claims 2 and 3 of the present invention, the connector defined in claim 1 may be modified in which the width at the distal end of at lease either the engaging rib or the engaging projection is arranged greater than the width at the opening end of the engaging slot or the engaging recess. Therefore, when the header is inserted into the socket, the distal end of either the engaging rib or the engaging projection engages with the distal end of the engaging slot or the engaging recess thus creating a touch of click. As a result, the insertion of the header into the socket can be acknowledged and improved in the holding strength.

According to claim 4 of the present invention, the connector defined in claim 1 may be modified in which the engaging recess at the insertion slot and the engaging projection are located at substantially symmetry with relation to a point on the facing sides of the socket body and the header body respectively viewed from front. This allows the header to be inserted into the insertion slot of the socket body when having been turned substantially 180 degrees about the direction of insertion thus improving the utility of the connector.

According to claim 5 of the present invention, the connector defined in claim 1 may be modified in which the engaging recess at the insertion slot and the engaging projection are located at not symmetry with relation to a point on the facing sides of the socket body and the header body respectively viewed from front. This allows the header not to be inserted into the insertion slot of the socket body when having been turned substantially 180 degrees about the direction of insertion. As a result, the fault insertion of the header can be avoided and once the insertion is made, the connection between the contacts and the corresponding receiver contacts can definitely be ensured.

According to claim 6 of the present invention, the connector defined in claim 1 may be modified in which the engaging rib is located at substantially the center of the socket body. When socket is mounted by the suction action of a surface mounting device to a printed circuit board on which components are surface mounted, it can be held at the distal end of its engaging rib by the suction securely and balanceably. Consequently, the surface mounting action can stably be automated.

According to claim 7 of the present invention, the connector defined in claim 1 may be modified in which the engaging rib extends lengthwisely in and along the insertion slot of the socket body. This allows the socket body to be increased at its insertion slot in the rigidity and thus protected from deflection. Consequently, when the socket is mounted onto a printed circuit board, its contacts can be aligned at one end along one plane for ease of connection with the pattern of wiring of the printed circuit board.

According to claim 8 of the present invention, the connector defined in claim 7 may be modified in which the engaging rib extends up to both ends of the insertion slot while the header body has an opening therein provided at each lengthwise end of the engaging slot for engaging with both lengthwise end portions of the engaging rib along the direction of header insertion. This allows the socket body to be further increased in the rigidity and thus protected from deflection.

According to claim 9 of the present invention, the connector defined in claim 8 may be modified in which the height of the lengthwise end portions of the engaging rib along the direction of header insertion is equal to substantially a half the height of its center portion. This allows the header to be reduced in the depth of the openings at its lengthwise ends for engaging with the lengthwise end portions of the engaging rib and thus increased in the physical strength about the openings.

According to claim 10 of the present invention, the connector defined in claim 1 may be modified in which the engaging rib is located in the insertion slot of the socket body and has a slot provided lengthwisely in the back side thereof behind the insertion slot. This allows the socket body to be uniform in the thickness as thinning its engaging rib and thus protected from deflection as well as minimizing its material to be used.

According to claim 11 of the present invention, the connector defined in claim 1 may be modified in which each of the two lengthwise ends of the insertion slot of the socket body is raised higher from the bottom of the insertion slot than the other portion and has a beveled surface thereof sloping down towards the insertion slot. While the header is inserted into the socket, it can be guided by the beveled surface of the socket body before seated in the insertion slot. For example, the insertion of the header can be carried out by an automatic assembling device, e.g. a robot, without positioning error of the header to the insertion slot, thus inhibiting the header from striking against and injuring the side of the socket body at the insertion slot.

According to claim 12 of the present invention, the connector defined in claim 1 may be modified in which the engaging projection has a beveled surface provided on the distal end thereof becoming narrow towards the distal end. When the header is inserted into the socket, it can be guided by the beveled surface of the engaging projection so that its engaging projection smoothly engages with the engaging recess of the socket.

According to claim 13 of the present invention, the connector defined in claim 1 may be modified in which the engaging rib has a beveled surface provided on the distal end thereof becoming narrow towards the distal end. When the header is inserted into the socket, it can be guided with the beveled surface of the engaging rib so that the engaging rib of the socket smoothly engages with its engaging slot.

DETAILED DESCRIPTION OF THE PREFERRED EMBODIMENT OF THE PRESENT INVENTION

Embodiment 1

Figure 1A:
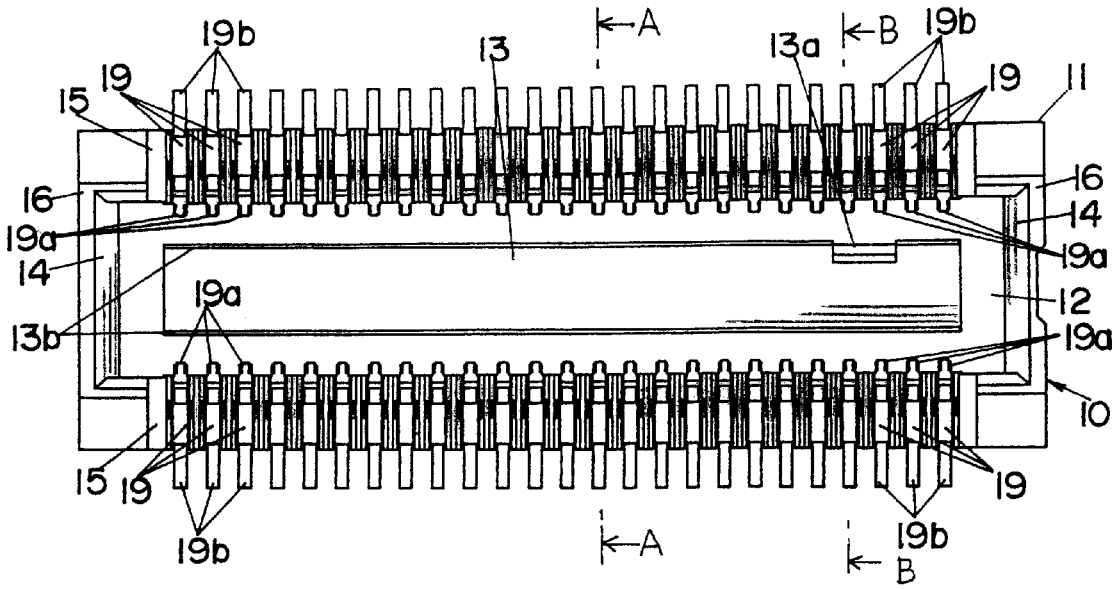
FIG. 1A is a front view of a socket and FIG. 1B is a front view of a header showing Embodiment 1 of the present invention.
Figure 1B:
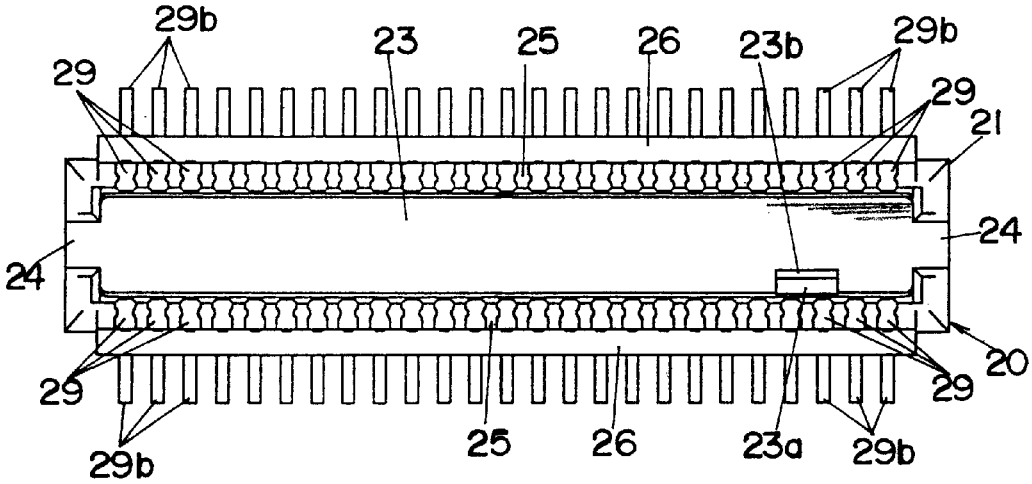
Figure 2A:
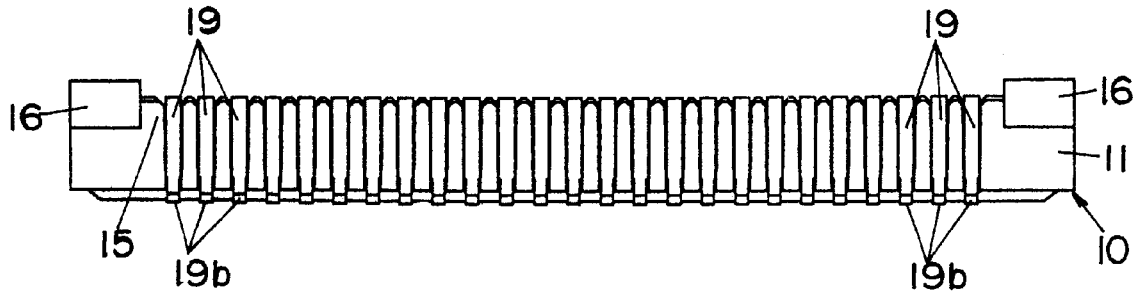
FIGS. 2A and 2B are side views of the socket.
Figure 2B:
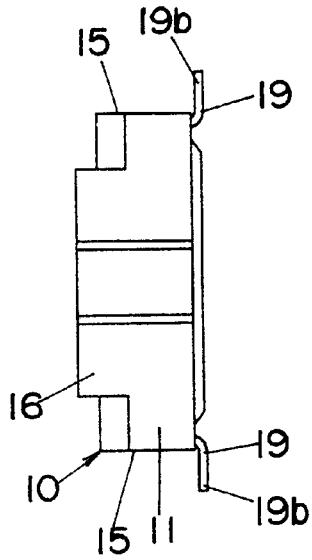
Figure 4A:
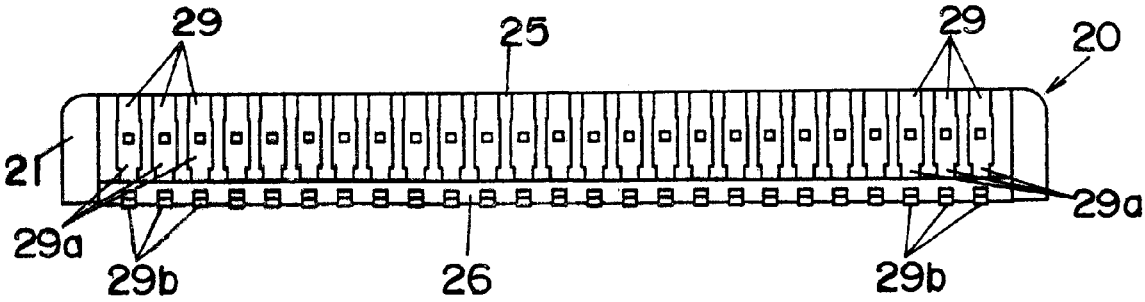
FIGS. 4A and 4B are side views of the header.
Figure 4B:
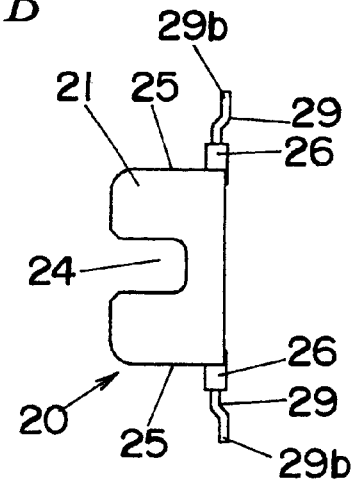

This embodiment comprises a socket 10 which includes a set of contacts 19 and a socket body 11 which is made of a resin mold having substantially a rectangular cylinder shape on which the contacts 19 are mounted, as best shown in FIGS. 1A, 2A, and 2B, and a header 20 which includes a set of receiver contacts (namely posts) 29 arranged directly connectable with the contacts 19 of the socket 10 and a header body 21 made of a resin mold having substantially a rectangular cylinder shape on which the receiver contacts 29 are mounted as shown in FIGS. 1B, 4A and 4B. In action, the header 20 is inserted into a substantially rectangular insertion slot 12 provided lengthwisely in the socket body 11 to connect the contacts 19 directly with the corresponding receiver contacts 29.

Figure 3A:
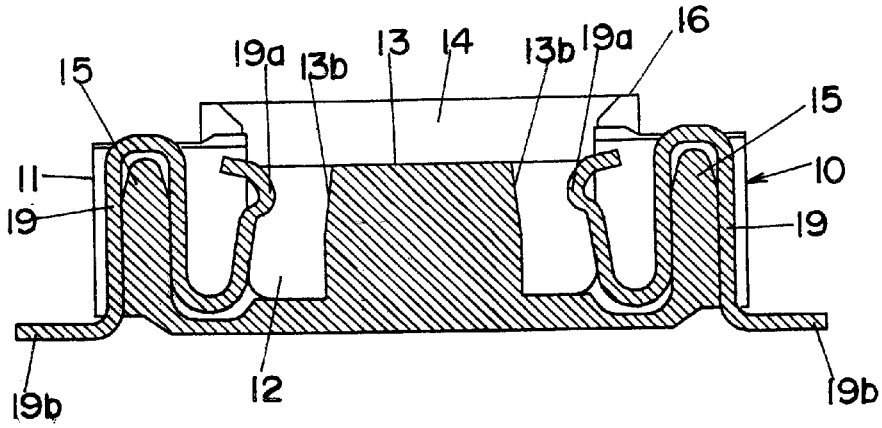
FIGS. 3A and 3B are cross sectional views of the socket taken along the line A—A showing no engaging recess and the line B—B showing an engaging recess.
Figure 3B:
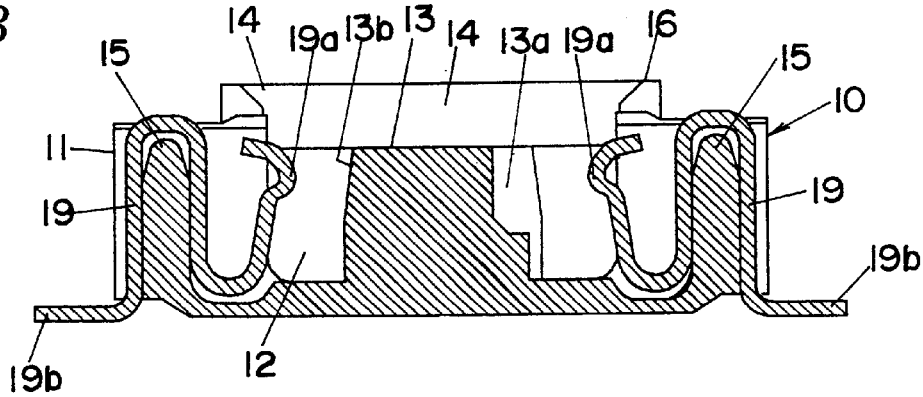

As shown in FIG. 3A, an engaging rib 13 is provided in the insertion slot 12 of the socket body 11 as extending lengthwisely of the insertion slot 12 and projecting substantially vertical from the bottom at the insertion slot 12 of the socket body 11. Also, the engaging rib 13 has an engaging recess 13*a* provided in one end region of one lengthwisely extending side thereof, as shown in FIG. 3B.

Each of the contacts 19 is arranged of substantially an S shape which holds from both sides a lengthwisely extending rim wall 15 of the socket body 11 provided along the insertion slot 12 so that its inner portion at the insertion slot 12 side remains flexible along a direction substantially orthogonal to the rim wall 15. The distal end of the contact 19 is inwardly curved in the insertion slot 12 to make up a contactor portion 19*a* which comes into direct contact with the receiver contact 29 of the header 20. The other or proximal end of the contact 19 provided at the outside of the insertion slot 12 is outwardly bent at the back of the socket body 11 to extend substantially orthogonal to the rim wall 15 and make up a contactor portion 19*b* which is joined by soldering or the like to a pattern of wiring of a printed circuit board.

Figure 5A:
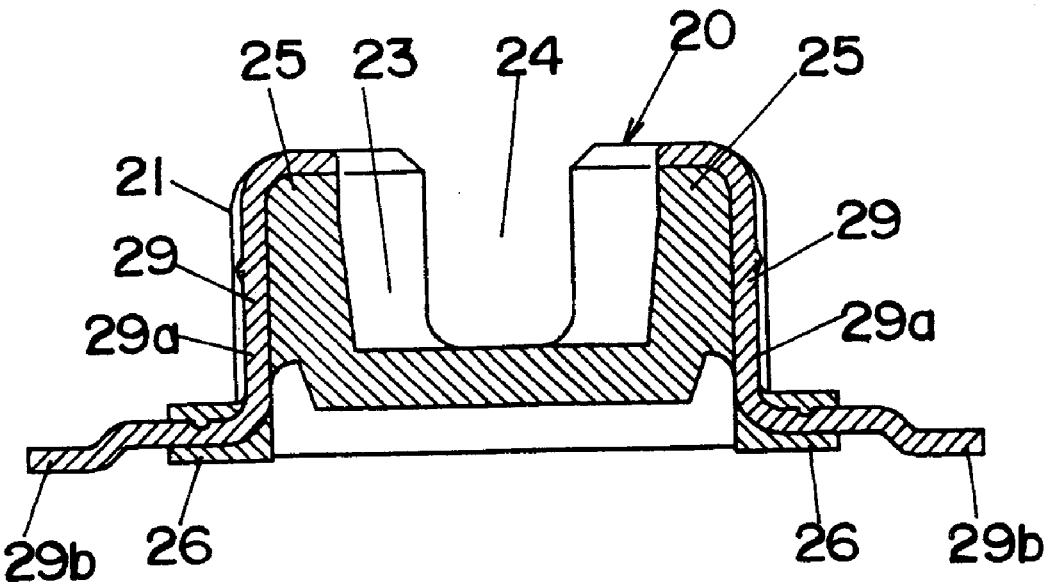
FIGS. 5A and 5B are cross sectional views of the header without and with an engaging projection.
Figure 5B:
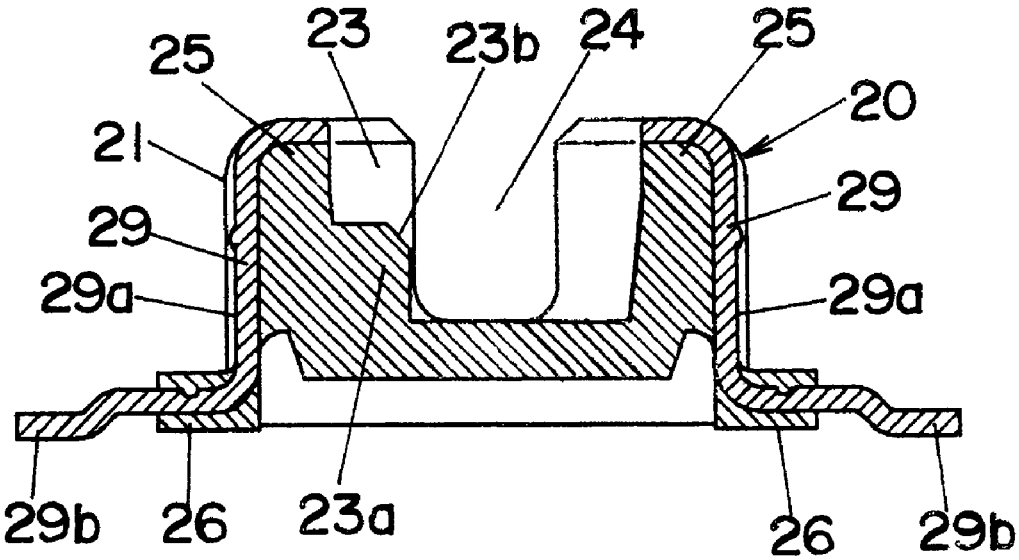

The header body 21 also has a lengthwisely extending engaging slot 23 provided therein at a location opposite to the engaging rib 13 of the socket 10 for engaging directly with the engaging rib 13, as shown in FIG. 5A. As best shown in FIG. 5B, the header body 21 has an engaging projection 23*a* provided integrally on a rim wall 25 thereof at a location in the engaging slot 23 substantially opposite to the engaging recess 13*a* of the socket 10 for direct engagement with the engaging recess 13*a*.

The header body 21 has a couple of openings 24, 24 provided therein at both lengthwise ends of the engaging slot 23 for communicating the engaging slot 23 with the outside and also a couple of flanges 26 thereof extending substantially orthogonal from their corresponding rim walls 25, 25 at the edge of the back side of the header body 21 which face each other about the engaging slot 23 along the lengthwise direction.

Each of the receiver contacts 29 is implanted to extend along the outer surface of the rim wall 25 substantially orthogonal to the lengthwise direction of the header body 21 and its one end projects at the back side of the header body 21 from the flange 26 substantially orthogonal to the rim wall 25. As the receiver contact 29 extends along the outer surface of the rim wall 25, its other end makes up a contactor portion 29*a* arranged connectable with the contactor portion 19*a* of the contact 19 of the socket 10 at the side of the flange 26 and its one end extending outwardly of the flange 26 makes up a connector portion 29*b* which can be joined by welding or the like to a pattern of wiring of a printed circuit board.

The socket 10 and the header 20 of this embodiment are generally joined at the contactor portion 19*b* of each contact 19 and the contactor portion 29*b* of each receiver contact 29 by soldering or surface mounting technique to two different patterns of wiring of printed circuit boards respectively. For example, as the socket 10 is picked up by suction by a surface mounting device for surface mounting onto a printed circuit board, its engaging rim 13 provided at substantially the center of the socket body 11 can securely be held with the facing side acting as the suction surface at balance and then steadily surface mounted on the printed circuit board by an automatic mounting means.

Figure 6A:
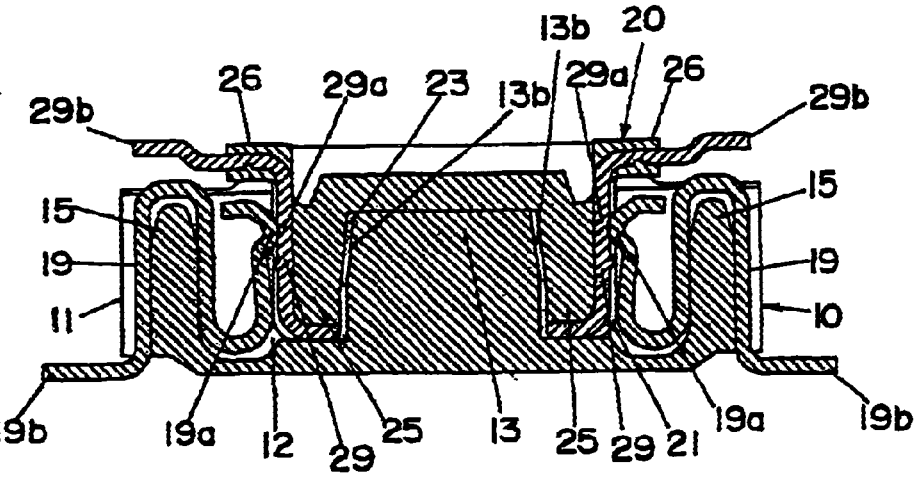
FIGS. 6A and 6B are cross sectional views of the header inserted into the socket without and with the engaging recess and the engaging projection.
Figure 6B:
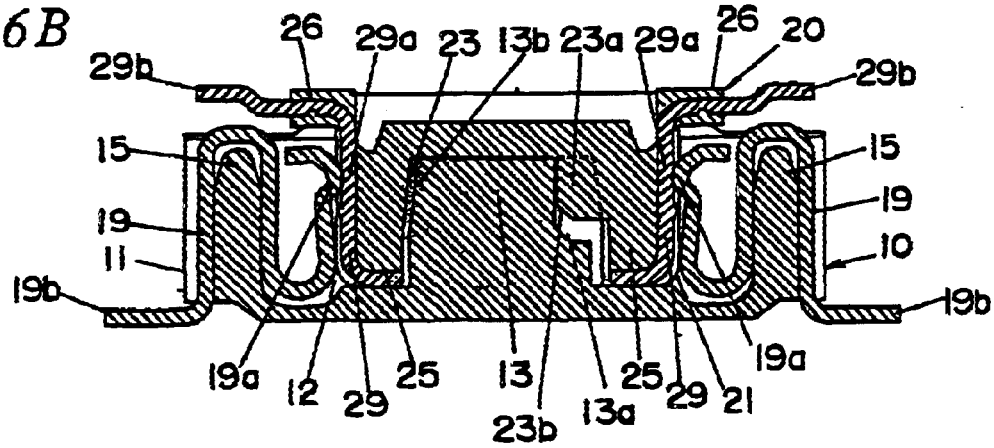

For connection, the header 20 is inserted into the insertion slot 12 of the socket 10 so that its engaging slot 23 and engaging projection 23*a* come in engagement with the engaging rib 13 and the engaging recess 13*a* of the socket 10. More specifically, the engaging rib 13 of the socket 10 is engaged directly with the engaging slot 23 of the header 20 as shown in FIG. 6A while the engaging projection 23*a* of the header 20 is accepted by the engaging recess 13*a* of the socket 10 as shown in FIG. 6B. When the header 20 is inserted into the socket 10, the contactor portions 29*a* of its receiver contacts 29 are caught by the contactor portions 19*a* of the contacts 19 in the insertion slot 12 of the socket which are biased towards the rim wall 15 and then returned back by the effect of their resiliency. As a result, the patterned wiring of the printed circuit board joined to the header 20 is electrically connected to the patterned wiring of the printed circuit board joined to the socket 10.

While its engaging recess 13*a* securely accepts the engaging projection 23*a* of the header 20, the socket 10 carried on an apparatus including a couple of the printed circuit boards connected to each other by the combination of the socket 10 and the header 20 can favorably be protected from any injury with the solid center of its socket body 11 about the engaging recess 13*a,* which is increased in the physical strength thus creating no weld lines, cushioning the impact generated by the header 20 substantially orthogonal to the direction of insertion particularly at the location of the socket body 11 about the insertion slot 12 where weld lines may easily be developed. Accordingly, the rim wall 19 of the socket body 11 can be thinned thus contributing to the size reduction of the connector. Although the engaging projection 23*a* of the header body 21 receives a fraction of the impact at the time, its shape extends lengthwisely of the header body 21 and is formed integral with the rim walls 25 thus having a strength enough to offset the fraction of the impact.

As the engaging recess 13*a* and the engaging projection 23*a* are smaller in the width than the socket body 11 and the header body 21, they may hardly be affected by thermal expansion or contraction but remain substantially constant in the dimensions. With the engaging recess 13*a* closely engaged with the engaging projection 23*a,* the positioning between the socket body 11 and the header body 21 is higher improved. Simultaneously, as the contacts 19 and the corresponding receiver contacts 29 are securely joined to each other, the electrical connection between the socket 10 and the header 20 can remain free from contact error.

Moreover, since its engaging rib 13 extending lengthwisely along the bottom of the insertion slot 12 is rigid enough to increase the physical strength at the insertion slot 12 of the socket body 10, the socket body 10 can be minimized in the deflection. As a result, the contactor portions 19*b* of the contacts 19 can be aligned on substantially one plane thus permitting the socket 10 to be mounted on the printed circuit board with ease.

As the engaging recess 13*a* and the engaging projection 23*a* are provided at not symmetry with respect to a point on the facing sides of the insertion slot 12 of the socket body 11 and the header body 21 respectively viewed from front, the header 20 turned 180 degrees about the direction of insertion from its correct position can be inhibited from inserting into the insertion slot 12 of the socket body 11. In other words, the header 20 can be protected from being seated in a reverse position and its receiver contacts 29 can exactly be connected with the corresponding contacts 19 of the socket 10.

Figure 7:
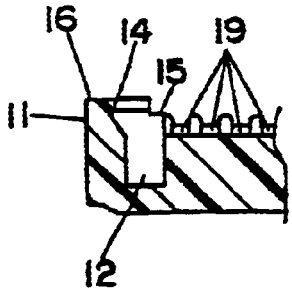
FIG. 7 is a cross sectional view showing a primary part of the socket.

As shown in FIG. 7, each of the two lengthwise ends 16 at the insertion slot 12 of the socket body 11 is arranged higher from the bottom of the insertion slot 12 than the rim wall 15 and has a beveled surface 14 provided on the distal end thereof sloping down towards the insertion slot 12. This allows the header 20 to be guided during the insertion as moved downwardly along the beveled surface 14 into the insertion slot 12 of the socket body 11. For example, when the header 20 is systematically inserted by the action of an automated assembly device such as a handling robot, it remains at its correct position and can be inhibited from injuring the socket body 11 through being pressed against the inner wall at the insertion slot 12 of the socket body 11.

Also, the engaging rib 13 of the socket 10 has beveled surfaces 13*b,* 13*b* provided on both side thereof becoming narrow towards the distal end. Accordingly, when the header 20 is inserted into the socket 10, its inner wall at the engaging slot 23 is guided by the beveled surfaces 13*b,* 13*b* and smoothly moved until the engaging slot 23 is closely engaged with the engaging rib 13 of the socket 10. The engaging projection 23*a* of the header 20 has a beveled surface 23*b* provided thereon becoming narrow towards the distal end. Similarly, the engaging projection 23*a* is smoothly guided with its beveled surface 23*b* before finally accepted in the engaging recess 13*a* of the socket 10.

Figure 8A:
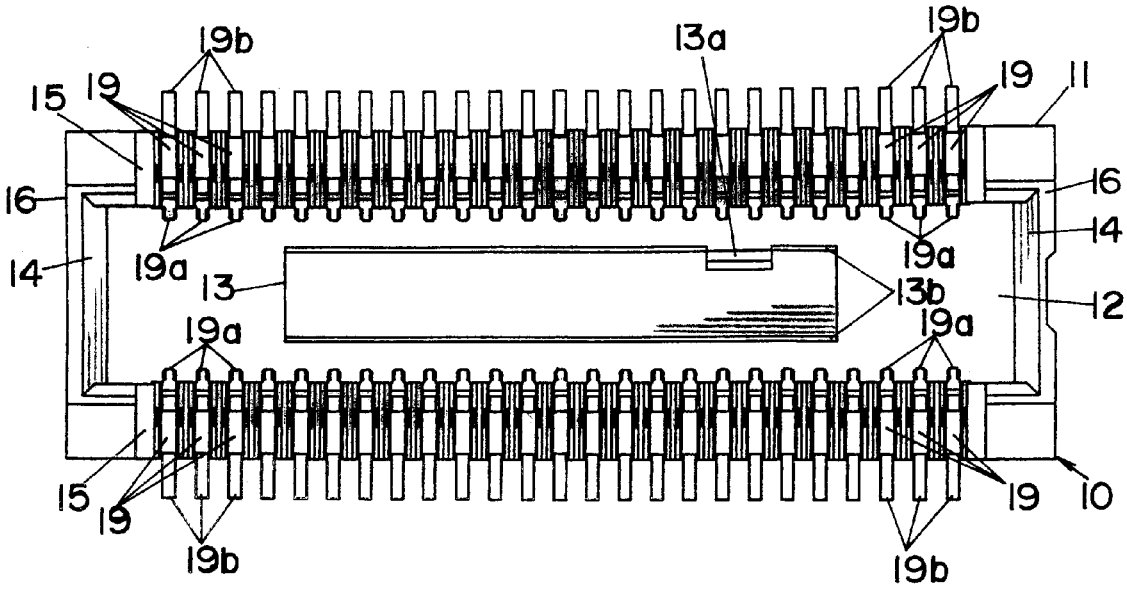
FIG. 8A is a front view of the socket and FIG. 8B is a front view of the header showing a modification of the connector.
Figure 8B:
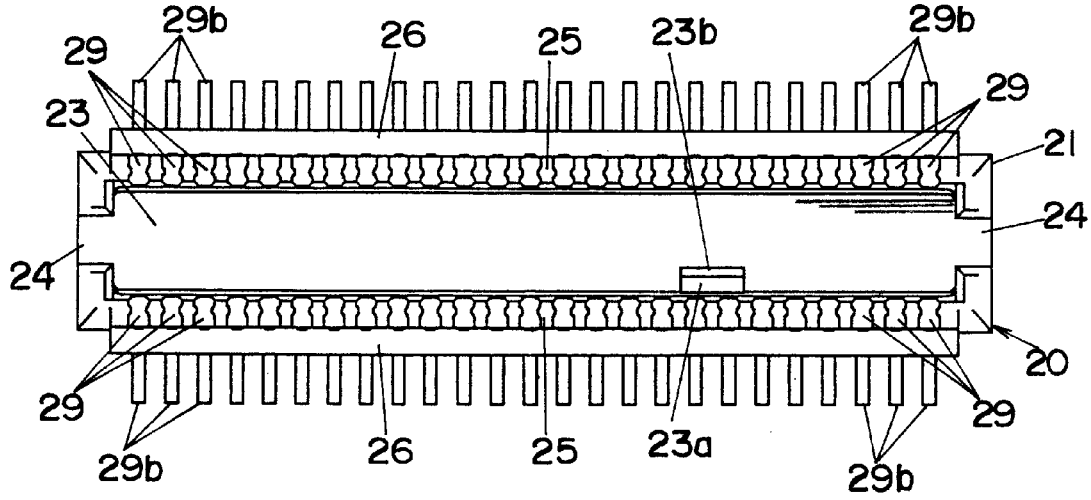

Alternatively, as shown in FIGS. 8A and 8B, the length of the engaging rib 13 may be reduced to minimize the material to be used. In case that the engaging rib 13 is provided at substantially the center of the socket body 11, as described previously, its top surface can easily be held by the suction of a surface-mounting device thus permitting the mounting process to be stable and consistent.

Embodiment 2

Like components in this embodiment are denoted by like numerals as those of Embodiment 1 and will be described in no more detail. Specific features of this embodiment are only explained in detail.

Figure 9A:
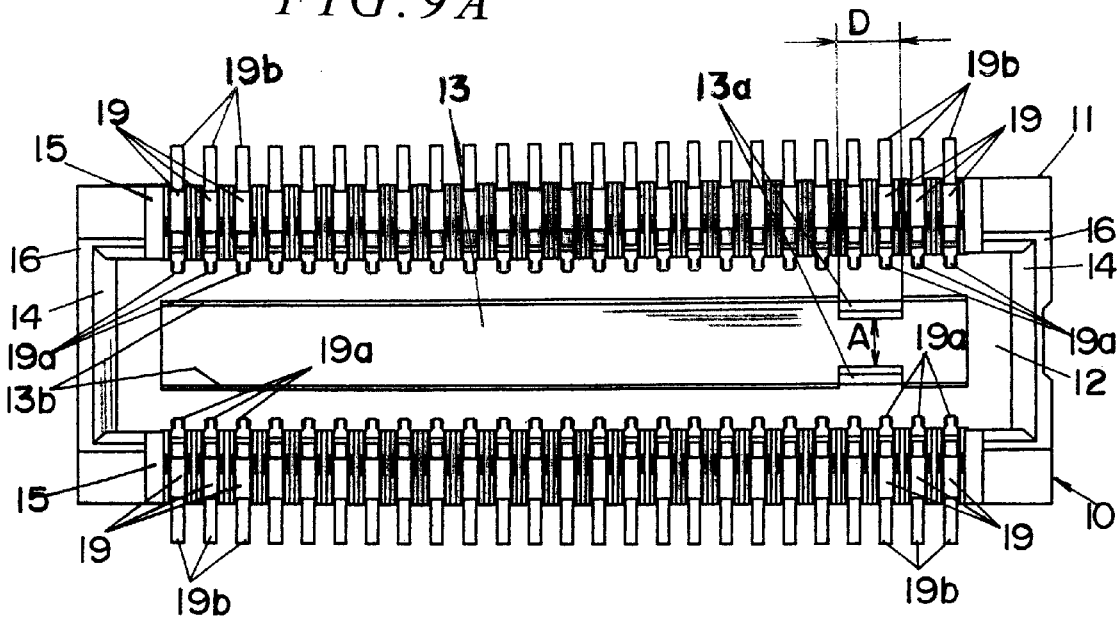
FIG. 9A is a front view of a socket and FIG. 9B is a front view of a header showing Embodiment 2 of the present invention.
Figure 9B:
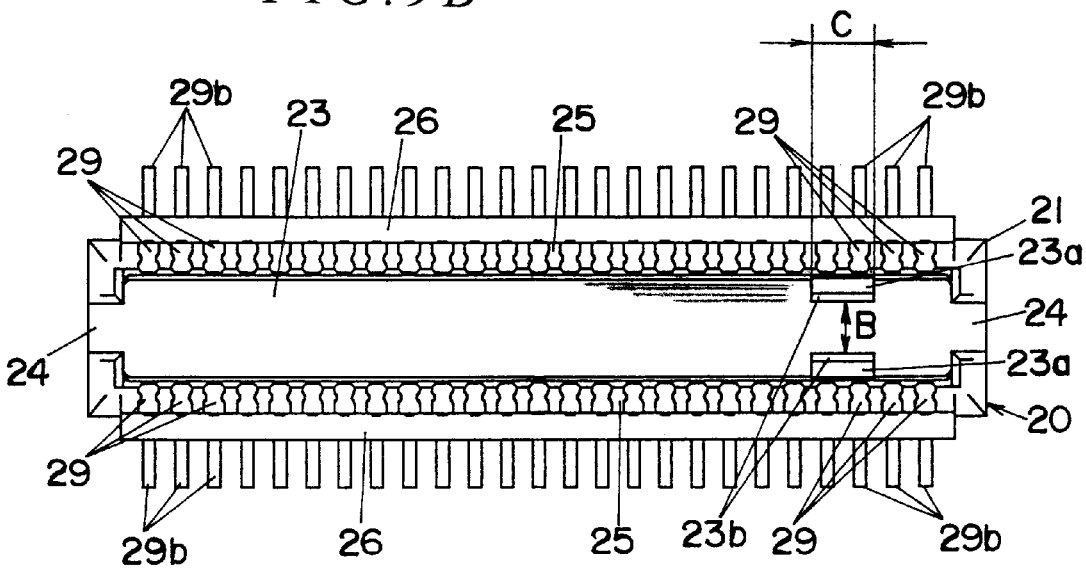
Figure 10:
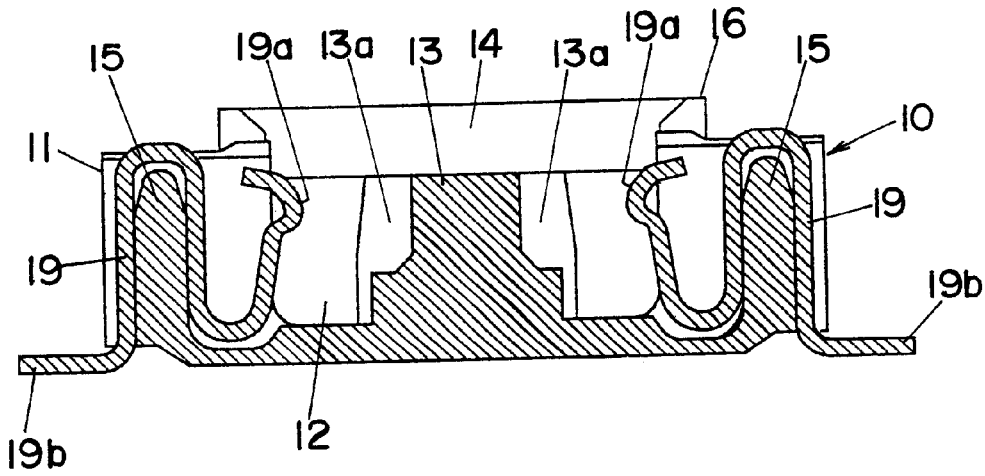
FIG. 10 is a cross sectional view of the socket with a pair of engaging recesses.
Figure 11A:
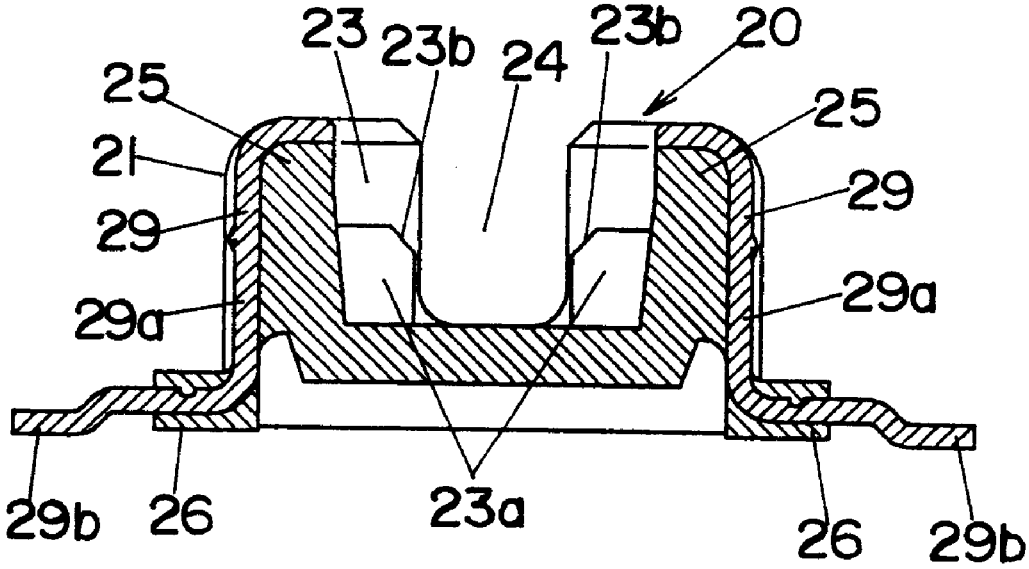
FIGS. 11A and 11B are cross sectional views of the header without and with a pair of engaging projections.
Figure 11B:
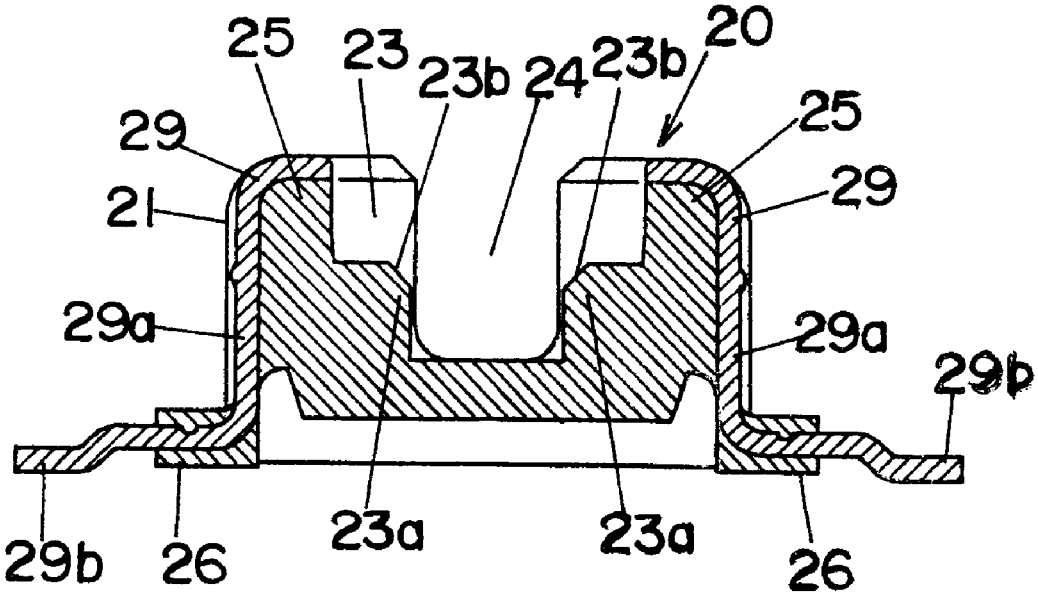

As shown in FIGS. 9A and 9B, a connector of this embodiment includes a pair of engaging recesses 13*a* and a pair of engaging projections 23*a* for close engagement respectively. The two engaging recesses 13*a,* 13*a* are provided in substantially the opposite sides of an end portion of the lengthwisely extending engaging rib 13, as shown in FIG. 10. Similarly, the two engaging projections 23*a,* 23*a* are provided on substantially the opposite sides of an end portion in the engaging slot 23 of the lengthwisely extending engaging inner wall of the header 20, as shown in FIGS. 11A and 11B.

The crosswise distance A between the two opposite engaging recesses 13*a,* 13*a* at one end of the engaging rib 13 is slightly greater than the crosswise distance B between the two opposite engaging projections 23*a,* 23*a* at one end of the engaging slot 23.

Figure 12:
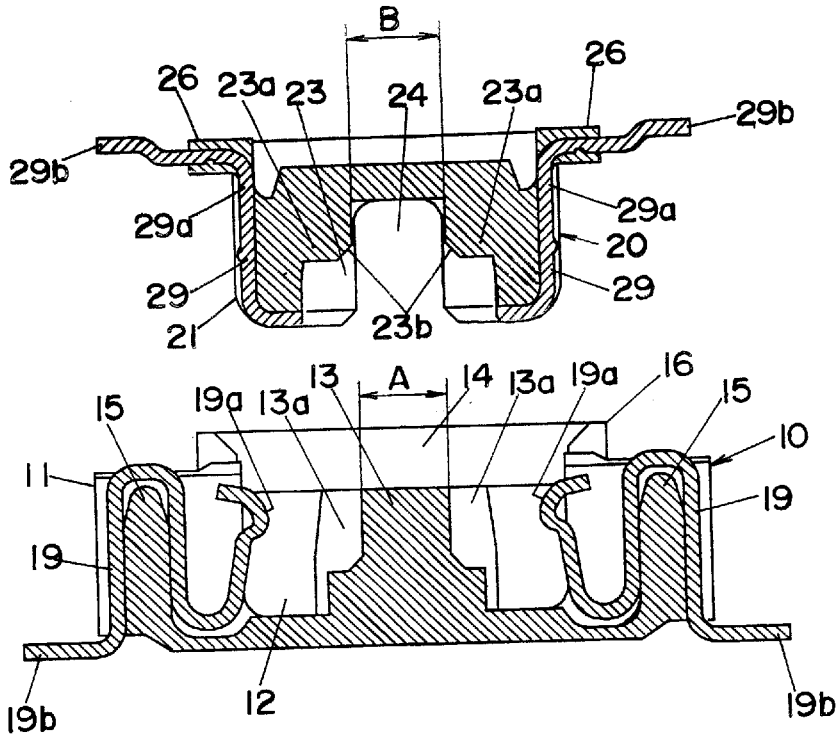
FIG. 12 is a cross sectional view of the header being inserted into the socket.
Figure 13:
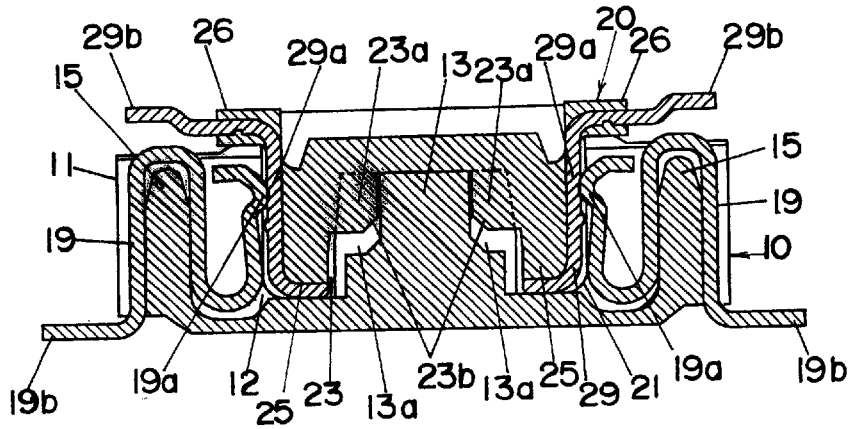
FIG. 13 is a cross sectional view of the header inserted into the socket.

As the crosswise distance A of its engaging rib 13 is slightly greater than the crosswise distance B of the engaging slot 23 as shown in FIG. 12, the socket 10 allows the header 20 to generate a touch of click upon the distal end of its engaging rib 13 between the two engaging recesses 13*a,* 13*a* fitting directly between the two engaging projections 23*a,* 23*a* of the engaging slot 23 so that the insertion of the header 20 into the socket 10 can be acknowledged. As shown in FIG. 13, the header 20 is inserted into the socket 10 until the contactor portions 29*a* of its contacts 29 come into direct contact with the corresponding contactor portions 19*a* of the contacts 19 of the socket 10 and can thus be retained at a higher strength by the socket 10. Accordingly, the header 20 will be inhibited from being simply detached from the socket 10 by unwanted stress such as vibrations.

Alternatively, the lengthwise distance C of at least one of the two engaging projections 23*a,* 23*a* along the length of the header body 21 may be slightly longer than the lengthwise distance D of the corresponding engaging recess 13*a* in the socket body 11 as shown in FIGS. 9A and 9B. This will also create a touch of click upon the insertion. In the claims of the present invention, the distances A, B, C, and D are expressed as widths.

This embodiment is adapted like Embodiment 1 where the engaging recesses 13*a* and the engaging projections 23*a* are positioned at substantially not symmetry with respect to a point on the facing sides of the insertion slot 12 of the socket body 11 and the header body 21 respectively, hence inhibiting the insertion of the header 20 in an inverted manner.

Although each pair of the engaging recesses 13*a* and the engaging projections 23*a* described are provided substantially opposite to each other about the center line, their arrangement is not limited to this embodiment. It may however be modified with equal success that the width of at least the engaging rib 13 or one of the engaging projections 23*a,* 23*a* is arranged slightly greater than the width of the engaging slot 23 or corresponding one of the engaging recesses 13*a,* 13*a*. Also, the engaging recess 13*a* and the engaging projection 23*a* are not limited to two sets of this embodiment but may be one set like in Embodiment 1 or three or more sets.

Embodiment 3

Like components in this embodiment are denoted by like numerals as those of Embodiment 2 and will be described in no more detail. Specific features of this embodiment are only explained in detail.

Figure 14A:
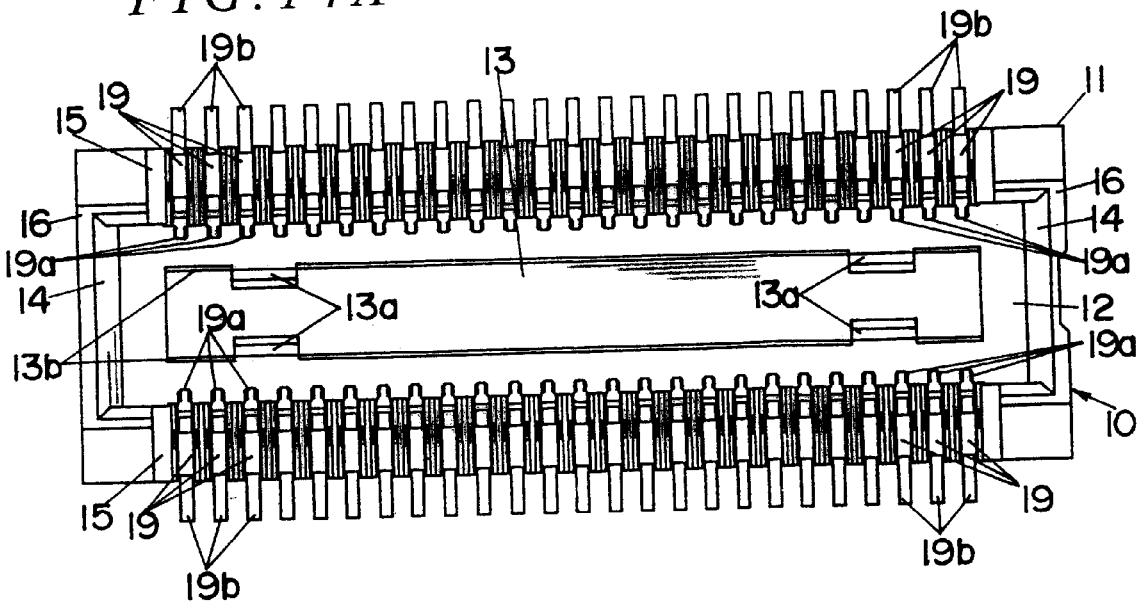
FIG. 14A is a front view of a socket and FIG. 14B is a front view of a header showing Embodiment 3 of the present invention.
Figure 14B:
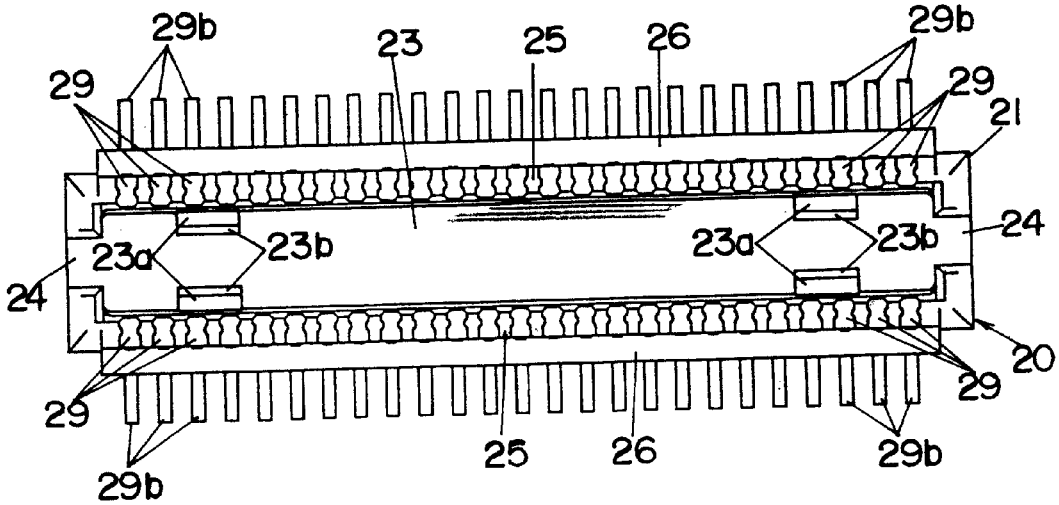

A connector of this embodiment includes four sets of the engaging recess 13*a* and the engaging projection 23*a* for close engagement with each other as shown in FIGS. 14A and 14B. More specifically, two pairs of the engaging recesses 13*a* are provided in substantially opposite sides of each end of the engaging rib 13 of the socket body 11 while two pairs of the engaging projections 23*a* are provided on substantially opposite sides of each end at the engaging slot 23 of the header body 21. As a result, their arrangement is substantially symmetrical with respect to a point on the facing side of either of the insertion slot 12 of the socket body 11 and the header body 21.

Accordingly, when the header 20 is turned substantially 180 degrees about the direction of insertion, it can correctly be inserted into the insertion slot 12 of the socket body 11 thus improving the utility of the connector.

Alternatively, the width at the distal end of either the engaging rib 13 or the engaging projection 23*a* may be arranged slightly greater than that of the engaging slot 23 or the engaging recess 13*a* to produce a touch of click when the header 20 is being inserted into the socket 10.

Moreover, the engaging recess 13*a* and the engaging projection 23*b* are provided four sets in this embodiment but may be provided one to three sets or not smaller than five sets.

Embodiment 4

Figure 15A:
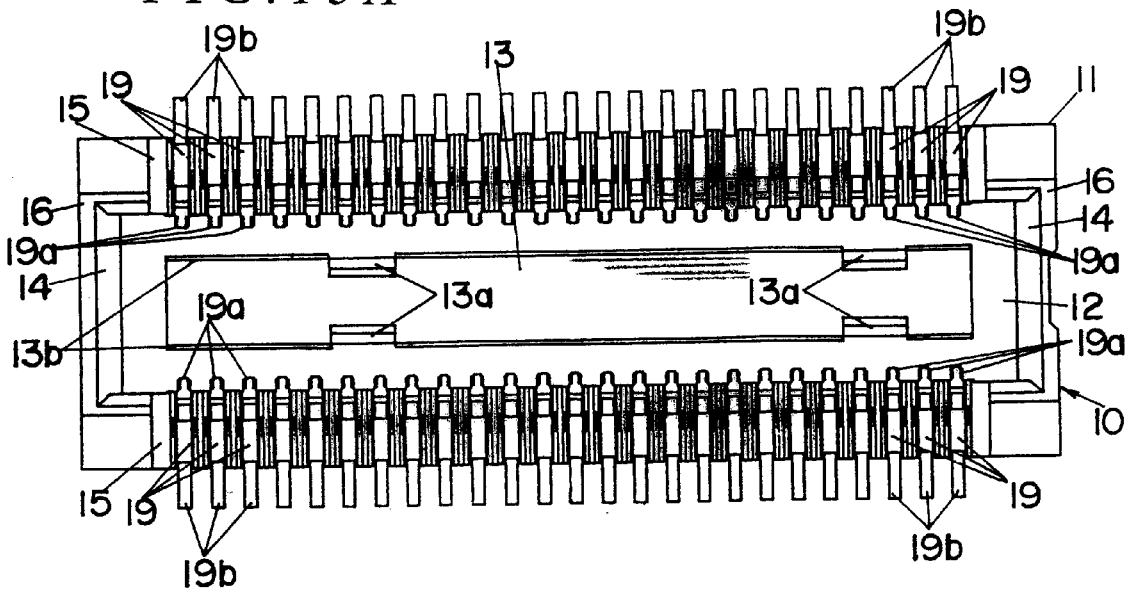
FIG. 15A is a front view of a socket and FIG. 15B is a front view of a header showing Embodiment 4 of the present invention.
Figure 15B:
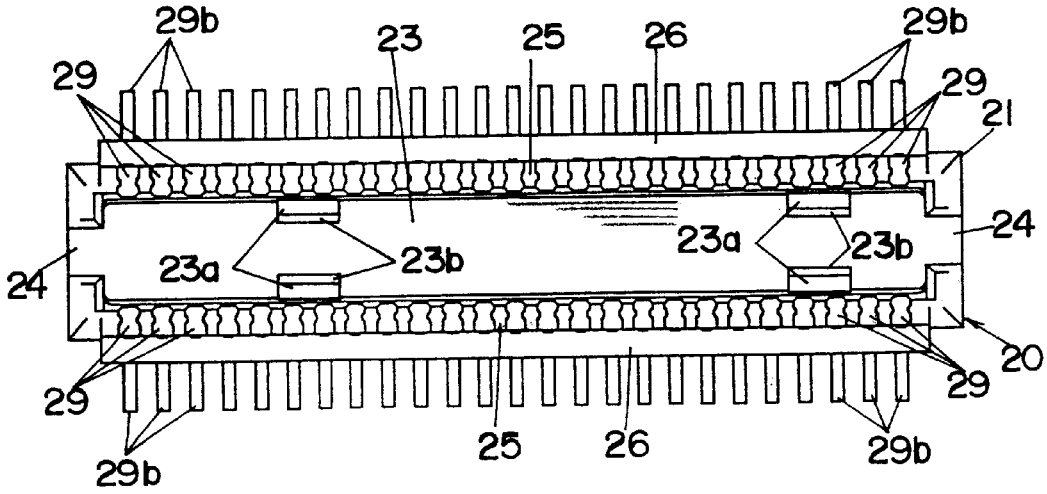

A connector of this embodiment like Embodiment 3 includes four sets of the engaging recess 13*a* and the engaging projection 23*a,* as shown in FIGS. 15A and 15B. Similar to the connectors of Embodiment 1 shown in FIGS. 1 and 8 and Embodiment 2 shown in FIG. 9, each pair of the engaging recesses 13*a* or the engaging projections 23*a* are positioned at not symmetry with respect to a point on the facing side of the insertion slot 12 of the socket body 11 or the header body 21 while two pairs of the same are located at different positions from their respective ends of the engaging rib 13 or the engaging slot 23.

This inhibits the header 20 from being inserted into the insertion slot 12 of the socket body 11 when turned substantially 180 degrees about the direction of insertion. In other words, the header 20 can correctly be inserted without directional error into the socket 10 so that its receiver contacts 29 come into direct contact with the corresponding contacts 19 of the socket 10.

Alternatively, the width at the distal end of either the engaging rib 13 or the engaging projection 23*a* may be arranged slightly greater than that of the engaging slot 23 or the engaging recess 13*a* in this embodiment similar to Embodiment 2. Also, the engaging recess 13*a* and the engaging projection 23*a* may be provided one to three sets or not smaller than five sets.

Embodiment 5

Like components in this embodiment are denoted by like numerals as those of Embodiment 3 or 4 and will be described in no more detail. Specific features of this embodiment are only explained in detail.

Figure 16:
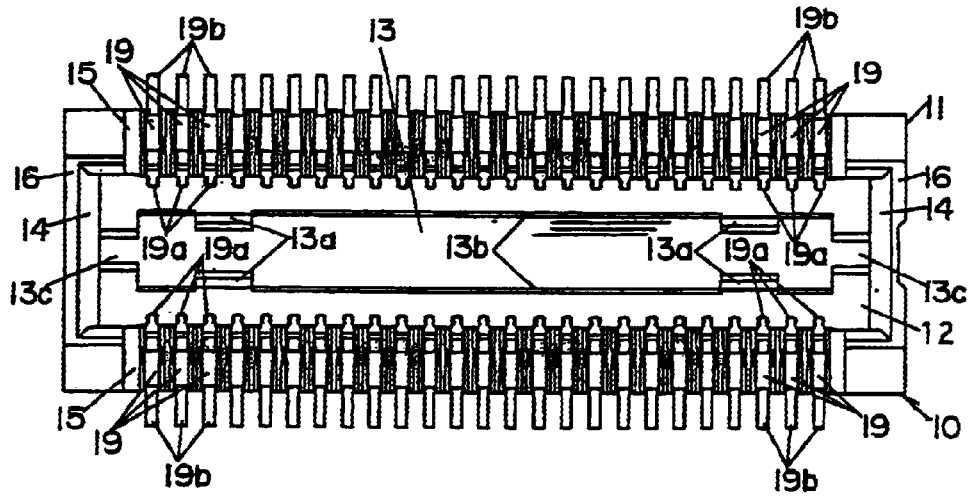
FIG. 16 is a front view of a socket showing Embodiment 5 of the present invention.

In this embodiment, the engaging rib 13 has a projection 13*c* provided on each lengthwise end thereof extending to one end of the insertion slot 12, as shown in FIG. 16.

The projection 13*c* is sized smaller in the width than the engaging rib 13 so that it can be accepted in the opening 24 of the header body 21 of Embodiment 3 shown in FIG. 14B upon the header 20 being inserted into the insertion slot 12 of the socket 10. Also, its height along the direction of insertion is arranged substantially equal to the height of the engaging rib 13.

With the projections 13*c* of its engaging rib 13 extending up to the ends of the insertion slot 12, the socket body 11 can be improved in the physical strength thus minimizing its deflection.

Figure 17A:
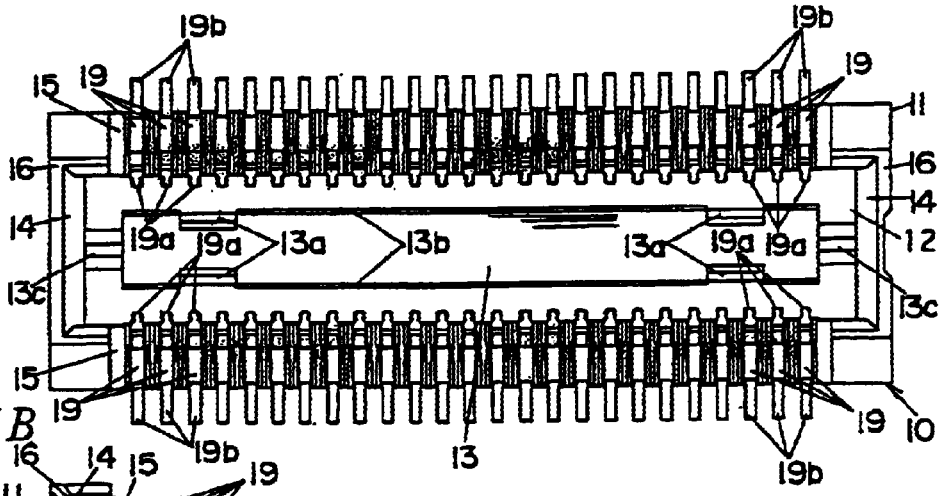
FIGS. 17A and 17B are a front view and a primary part cross sectional view of a modification of the socket.
Figure 17B:
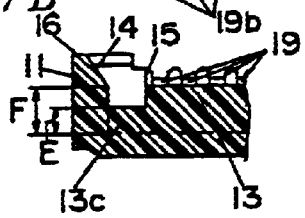
Figures 18A, 18B:
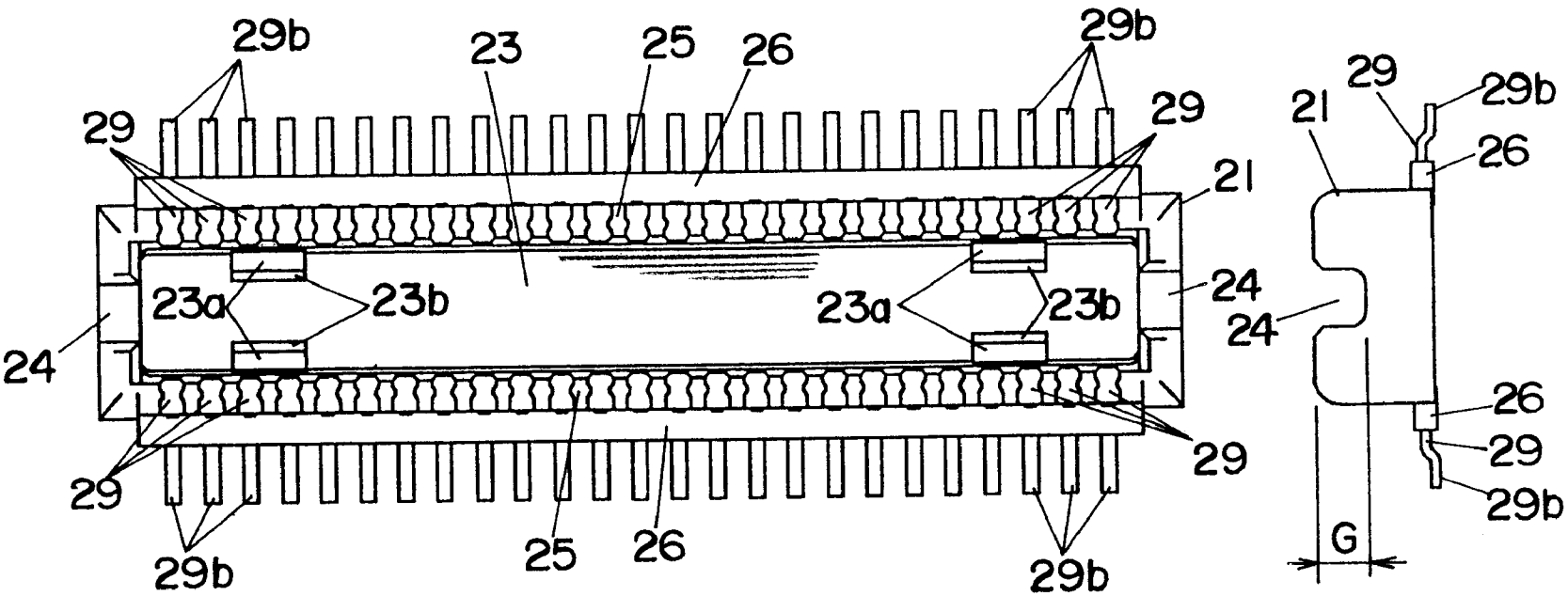
FIGS. 18A and 18B are a front view and a side view of a modification of the header to be inserted into a corresponding socket.

The height denoted by E of the projections 13*c* of the engaging rib 13 along the direction of insertion may be reduced to substantially a half the height denoted by F of the engaging rib 13 as shown in FIGS. 17A and 17B. Since the height E of the projection 13*c* is equal to a half the height F of the engaging rib 13, the depth G of the opening 24 in the header body 21 can be decreased to substantially a half thus increasing the physical strength of the header body 21 about of the openings 24, 24.

Embodiment 6

Like components in this embodiment are denoted by like numerals as those of Embodiments 1 to 6 and will be described in no more detail. Specific features of this embodiment are only explained in detail.

Figure 19:
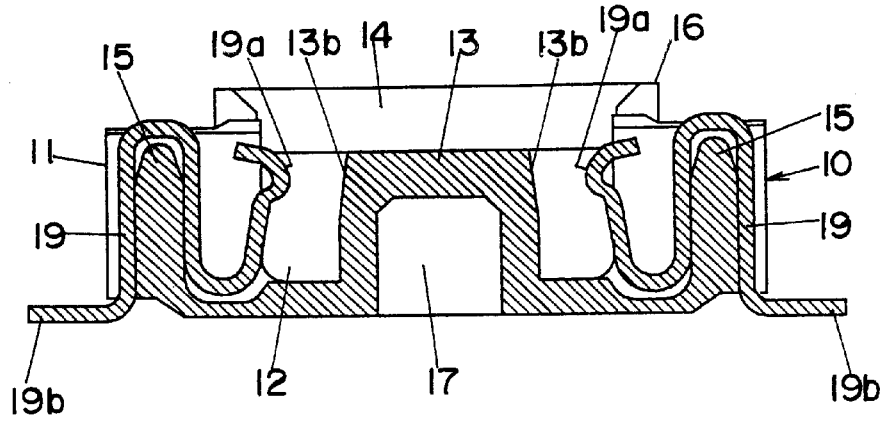
FIG. 19 is a cross sectional view of a socket showing Embodiment 6 of the present invention.
Figure 20:
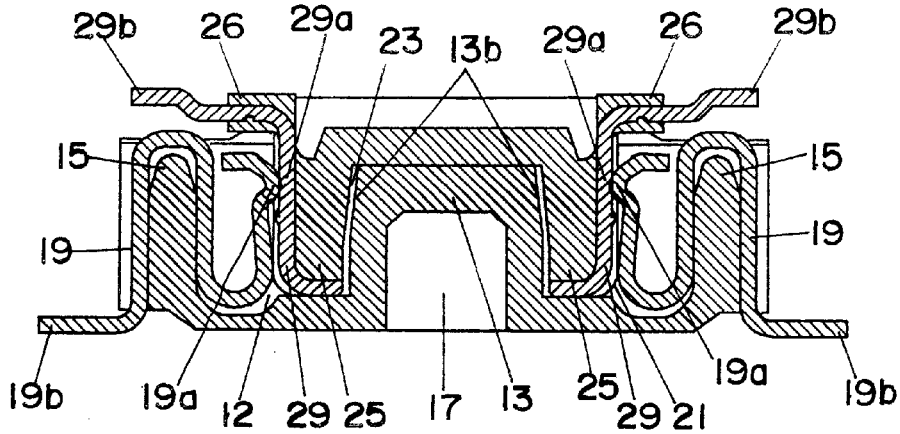
FIG. 20 is a cross sectional view of the socket accepting a header.
Figure 21A:
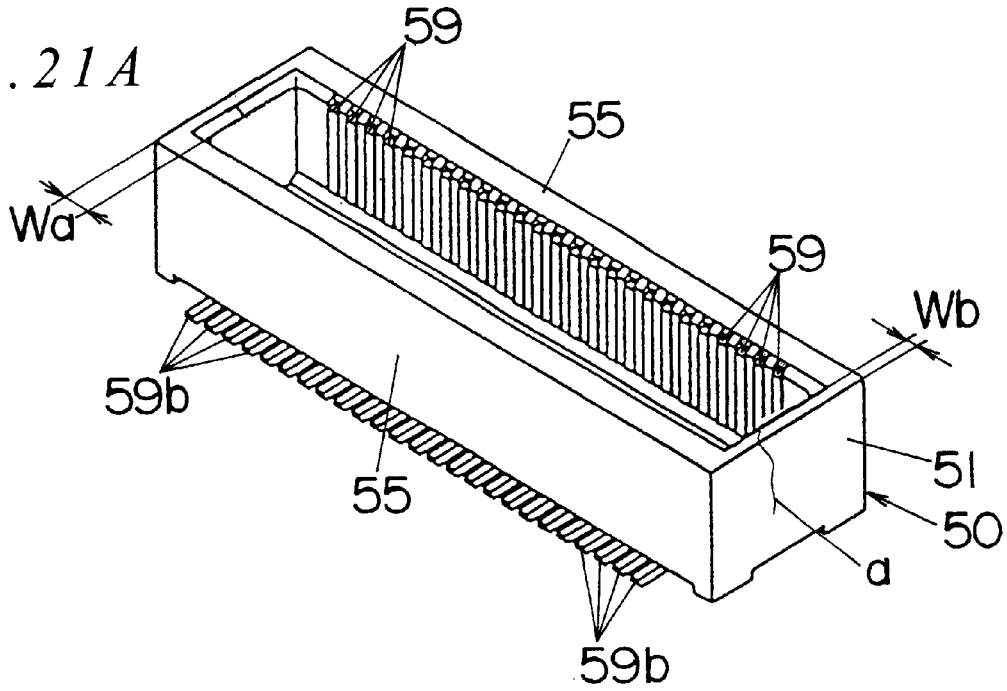
PRIOR ART FIG. 21A
FIG. 21A is a perspective view of a socket and FIG. 21B is a perspective view of a header showing a prior art.
Figure 21B:
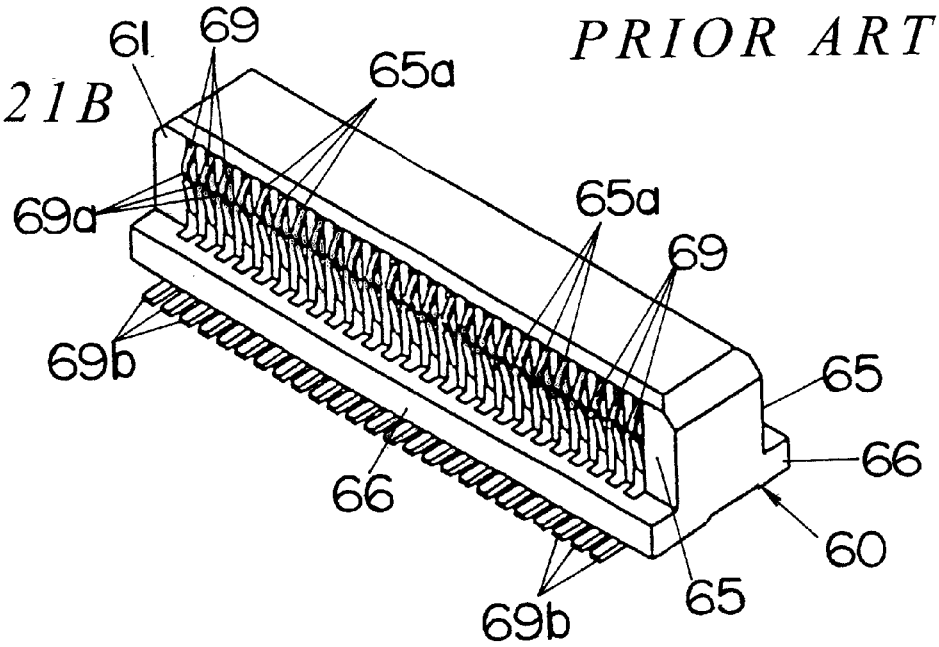
PRIOR ART FIG. 21B

In this embodiment, the socket body 11 has a slot 17 provided in and along the back of the engaging rib 13 thereof on the other side of the insertion slot 12 as shown in FIG. 19. FIG. 20 is a cross sectional view showing the header 20 inserted into the socket body 11 of the socket 10.

As apparent, the socket body 11 has the slot 17 and thus becomes substantially uniform in the thickness through thinning the engaging rib 13. Accordingly, the socket body 11 can further be protected from deflection while minimizing its material to be used.

INDUSTRIAL APPLICATION

As set forth above, each connector of the present invention can be protected from injury, minimized in the dimensions, and improved in the positioning accuracy of the socket body and the header body, thus ensuring the electrical connection between the contacts of the socket and the corresponding receiver contacts of the header without contact error.

What is claimed is:

1. A connector having a socket which comprises a plurality of contacts and a socket body of a molded form on which the contacts are aligned and a header which comprises a plurality of receiver contacts configured to be connectable with the corresponding contacts and a header body on which the receiver contacts are aligned, so that the header is insertable into an insertion slot of the socket body to electrically connect the contacts and the receiver contacts, the connector comprising:

an engaging rib provided at the bottom of the insertion slot on the facing side of the socket body and an engaging slot provided in the facing side of the header so that the two can be engaged with each other along the direction of header insertion, and at least one or more sets of engaging recesses and engaging projections provided in the facing side of the engaging rib and at the engaging slot on the facing side of the header respectively so that each set of engaging recesses and engaging projections can be engaged with each other along the direction of header insertion, the engaging recess and the engaging projection being configured to be tightly engaged each other so that impact load generated substantially orthogonal to the direction of header insertion is received by the engaging recess.

2. A connector according to claim 1, wherein the width at the distal end of the engaging rib has greater than the width at the distal end of the engaging slot.

3. A connector according to claim 1, wherein the width at the distal end of the engaging project is greater than the width at the distal end of the engaging recess.

4. A connector according to claim 1, wherein the engaging recess at the insertion slot and the engaging projection are located at substantially symmetry with relation to a point on the facing sides of the socket body and the header body respectively viewed from front.

5. A connector according to claim 1, wherein the engaging recess at the insertion slot and the engaging projection are located at not symmetry with relation to a point on the facing sides of the socket body and the header body respectively viewed from front.

6. A connector according to claim 1, wherein the engaging rib is located at substantially the center of the socket body.

7. A connector according to claim 1, wherein the engaging rib is located in the insertion slot of the socket body and has a slot provided lengthwisely in and along the back side thereof behind the insertion slot.

8. A connector according to claim 1, wherein each of the two lengthwise ends of the insertion slot of the socket body is raised higher from the bottom of the insertion slot than the other portion and has a beveled surface thereof sloping down towards the insertion slot.

9. A connector according to claim 1, wherein the engaging projection has a beveled surface provided on the distal end thereof becoming narrow towards the distal end.

10. A connector according to claim 1, wherein the engaging rib has a beveled surface provided on the distal end thereof becoming narrow towards the distal end.

11. A connector according to claim 1, wherein the engaging rib extends lengthwisely in and along the insertion slot of the socket body.

12. A connector according to claim 11, wherein the engaging rib extends up to both ends of the insertion slot while the header body has no opening therein provided at each lengthwise end of the engaging slot for engaging with both lengthwise end portions of the engaging rib along the direction of header insertion.

13. A connector according to claim 12, wherein the height of the lengthwise end portions of the engaging rib along the direction of header insertion is equal to substantially a half the height of its center portion.

* * * * *

UNITED STATES PATENT AND TRADEMARK OFFICE

CERTIFICATE OF CORRECTION

PATENT NO. : 6,623,308 B2
DATED : September 23, 2003
INVENTOR(S) : H. Ono

It is certified that error appears in the above-identified patent and that said Letters Patent is hereby corrected as shown below:

Column 11,
Line 22, of the printed patent, “has” should be -- is --.

Signed and Sealed this

Twenty-ninth Day of June, 2004

JON W. DUDAS
*Acting Director of the United States Patent and Trademark Office*